United States Patent [19]

Jurusz

[11] Patent Number: 4,735,157

[45] Date of Patent: Apr. 5, 1988

[54] ROTARY COMBUSTOR BARREL WITH WATER-COOLED BAFFLES

[75] Inventor: Miroslawa T. Jurusz, Robinson Township, Allegheny County, Pa.

[73] Assignee: Westinghouse Electric Corp., Pittsburgh, Pa.

[21] Appl. No.: 8,972

[22] Filed: Jan. 30, 1987

[51] Int. Cl.[4] ..... F27B 7/38

[52] U.S. Cl. ..... 110/246; 110/234; 110/257; 110/258; 432/116

[58] Field of Search ..... 110/233, 234, 235, 246, 110/255, 257, 258, 259, 267, 268, 275, 276, 295, 296; 432/103, 116, 118; 122/136 R, 137, 138, 153, 262, 235 D

[56] References Cited

U.S. PATENT DOCUMENTS

| | | | |
|---|---|---|---|
| 3,822,651 | 7/1974 | Harris et al. | 110/246 X |
| 4,066,024 | 1/1978 | O'Connor . | |
| 4,226,584 | 10/1980 | Ishikawa | 110/246 X |
| 4,398,471 | 8/1983 | Thomanetz | 110/235 |
| 4,437,418 | 3/1984 | Guillaume et al. | 110/246 |
| 4,655,146 | 4/1987 | Lemelson | 110/246 X |

FOREIGN PATENT DOCUMENTS

| | | | |
|---|---|---|---|
| 2033535 | 1/1971 | Fed. Rep. of Germany | 110/246 |

*Primary Examiner*—Steven E. Warner

[57] ABSTRACT

A combustion barrel used in a rotary combustor is constructed of cooling pipes joined by perforated webs to form a generally cylindrical side wall. Water-cooled baffle pipes are attached to the interior of the generally cylindrical side wall at widely spaced intervals. The baffle pipes and cooling pipes are coupled at an exit end of the combustion barrel to a ring header which in turn is coupled to heat exchanging equipment. The ring header supplies low-energy coolant from the heat exchanger to the cooling and baffle pipes and discharges high-energy coolant from the cooling and baffle pipes to the heat exchanging equipment. At an input end of the combustion barrel, the cooling and baffle pipes are coupled to U-tubes or a return header for returning the coolant to the ring header. Solid material is supplied at the input end of the combustion barrel for incineration. The combustion barrel is slowly rotated as the solid material is transported to the exit end of the barrel. The water-cooled baffle pipes agitate the solid material enabling more complete incineration of the solid material.

8 Claims, 5 Drawing Sheets

ROTARY COMBUSTOR BARREL WITH WATER-COOLED BAFFLES

BACKGROUND OF THE INVENTION

1. Field of the Invention

The present invention is related to a rotary combustor, or incinerator, for burning waste material and, more particularly, to an improvement in the water-cooled barrel used in such a rotary combustor.

2. Description of the Related Art

Proper disposal of solid waste has become an increasingly serious problem as existing sites for land disposal near capacity and new sites become increasingly difficult to locate. Incineration of combustible solid waste has long been used to reduce the quantity of solid matter needing disposal. However, older methods of incineration often resulted in incomplete combustion and were often wasteful, in that the heat generated from combustion was rarely used efficiently.

During the previous one to two decades, a device, known as a water-cooled rotary combustor, has been used increasingly to burn waste materials efficiently with the heat energy therefrom producing steam for use in generating electricity or for other industrial uses. Examples of rotary combustors are described in U.S. Pat. Nos. 3,822,651 to Harris et al.; 4,066,024 to O'Connor and 4,226,584 to Ishikawa. A general description of a rotary combustor is provided immediately below with reference to FIGS. 1A and 2A which illustrate the present invention as applied to a prior art combustor. A more detailed description will be provided later.

As illustrated schematically in a cross-sectional side elevational view in FIG. 1A, a water-cooled rotary combustor generally includes a combustion barrel 10 having a generally cylindrical side wall 30 affixed to annular support bands 35 which are received on rollers 12 to permit rotation about the longitudinal axis. The barrel 10 has a generally open input end 16 for receiving waste 14 and an exit end 18 from which heat (or flame) 20 and solid combustion products 22, i.e., ash, exit the barrel 10. Cooling of the barrel 10 is provided by cooling pipes 24 which form a substantial portion of the generally cylindrical side wall 30 of the barrel 10. Low-energy coolant, such as saturated water, is supplied via supply pipes 26 to the barrel 10 at the exit end 18 and high-energy coolant is discharged via the supply pipes 26 to heat exchanging equipment 27. The heat exchanging equipment reduces the heat energy in the coolant before it is returned to the barrel 10 by a pump 29.

As illustrated in FIG. 2A, the barrel 10 rotates in, e.g., a clockwise direction when viewed from the flue 28, at a slow rate, such as one-sixth rpm. As a result of the barrel's rotation, the waste material 14 is shifted to one side of the barrel 10, as it travels a spiral path downward from the input end 16 to the exit end 18. However, the barrel 10 typically rotates at such a slow rate that some material often remains on the bottom for a significant portion of its travel down the length of the combustion barrel 10.

As a result, a portion of the waste material 14 is not exposed to a sufficient amount of heat and air to be fully incinerated. When this occurs, the solid combustion products 22 exiting the exit end 18 of the combustion barrel 10 include not only ash, but also chunks of material which may be charred, but still retain a significant amount of their original mass. Since one of the objectives of using a rotary combustor is to minimize the quantity of material which is to be disposed, the output of unburned material from the combustion barrel 10 is undesirable.

U.S. Pat. No. 4,066,024 to O'Connor describes one attempt in the prior art to increase agitation of material inside a combustion barrel. The O'Connor '024 patent is directed to a fluidized bed rotary combustor containing heated sand in the combustion barrel. Curved fins are attached to the interior surface of the combustion barrel to transport a portion of the sand to the top of the combustion barrel to provide more even heating of the sand. The fins are attached to air ducts having openings which help increase the air flow through the sand above that which would be provided by a conventional rotary combustor. Since the fins and air ducts are not water-cooled, they must be formed of materials which are capable of withstanding higher temperatures than the temperatures to which the carbon steel cooling pipes 24 are subjected.

SUMMARY OF THE INVENTION

An object of the present invention is to provide a combustion barrel in which combustible material is transported from the side wall of the combustion barrel into a flame area in an improved manner and so as to achieve more complete combustion.

Another object of the present invention is to provide baffles for agitating combustible material in a combustion barrel of a rotary combustor.

Yet another object of the present invention is to provide water-cooling for baffles which produce such agitation of combustible material.

The above objects are attained by providing a combustion barrel in a rotary combustor used for burning solid material, the rotary combustor being connected to heat exchanging equipment. The combustion barrel comprises a generally cylindrical side wall rotatable about a central axis of rotation and having input and exit ends, the axis being inclined slightly from the horizontal, proceeding downwardly from the input end to the exit end. The generally cylindrical side wall is formed by cooling pipes, extending in spaced, parallel axial relationship in a longitudinal direction and having first and second pipe ends, disposed adjacent the exit and input ends of the barrel, respectively. The cooling pipes are joined by longitudinally extending gas-porous interconnections, such as perforated webs. Each of the gas-porous interconnections are disposed intermediate an adjacent pair of the cooling pipes and rigidly interconnect same.

In accordance with the present invention, the combustion barrel further comprises a plurality of water-cooled baffle pipes and a special, associated ring header. The baffle pipes are attached to the interior of said generally cylindrical side wall of the barrel at widely spaced locations about the interior circumference, extending longitudinally in parallel axial relationship with the barrel, and having first and second pipe ends. The baffle pipes agitate the solid material as the combustion barrel is rotated. The ring header has a generally annular shape, is coupled to the heat exchanging equipment and the first pipe ends and supplies coolant to, and discharges coolant from, the cooling pipes and the baffle pipes. Finally, the combustion barrel includes return means interconnecting the respective, second ends of a first set, or grouping of the cooling and baffle pipes and a second set, or grouping, thereof, for returning the coolant from the second ends of the second set of the cooling and baffle pipes to the ring header.

These objects, together with other objects and advantages which will be subsequently apparent, reside in the details of construction and operation as more fully hereinafter described and claimed, reference being had to the accompanying drawings forming a part hereof, wherein like reference numerals refer to like parts throughout.

DESCRIPTION OF THE PREFERRED EMBODIMENTS

Figure 1A:
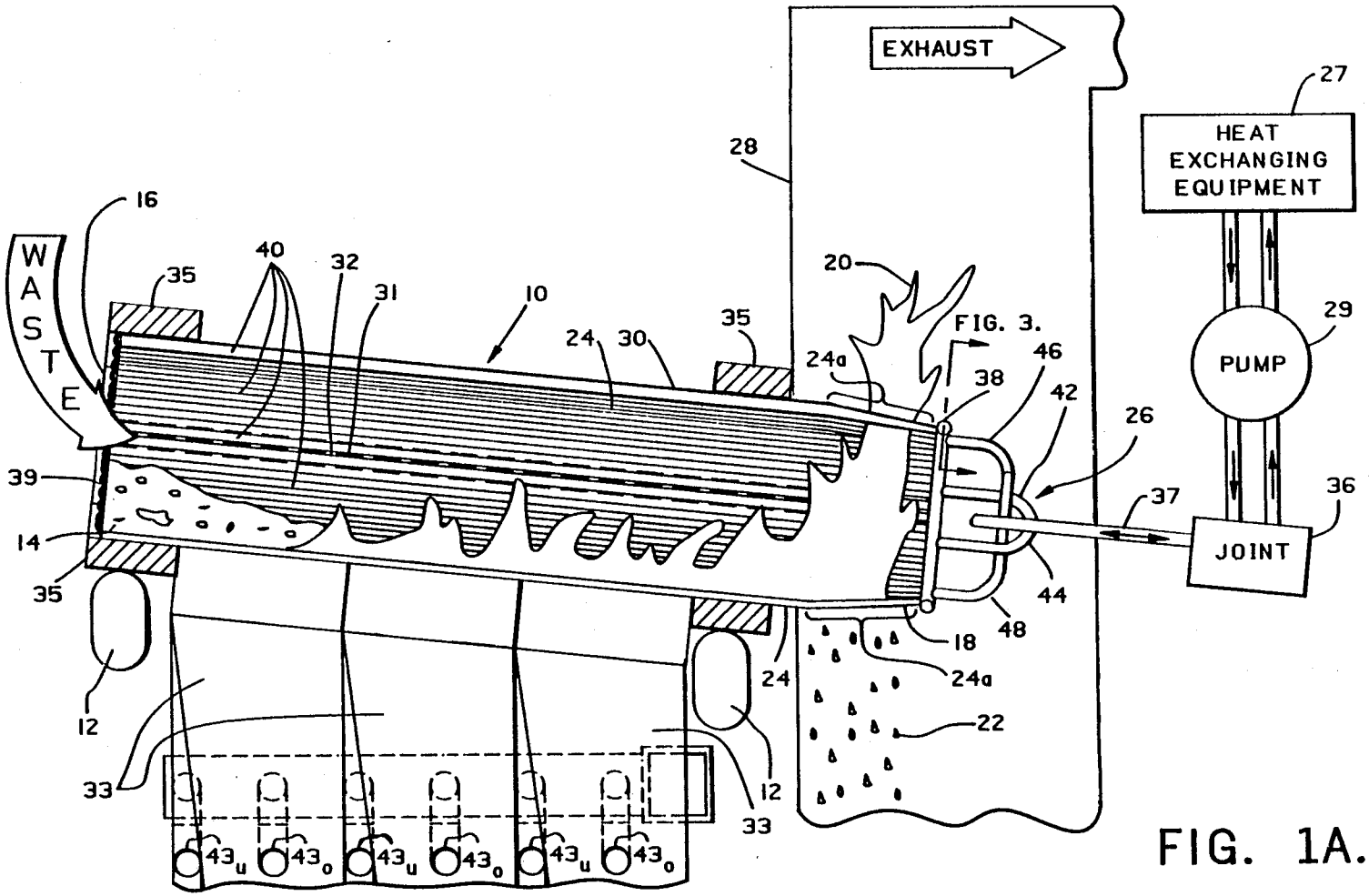
FIG. 1A is a cross-sectional, side elevational schematic view of a rotary combustor incorporating water-cooled baffles according to a first embodiment of the present invention.
Figure 1B:
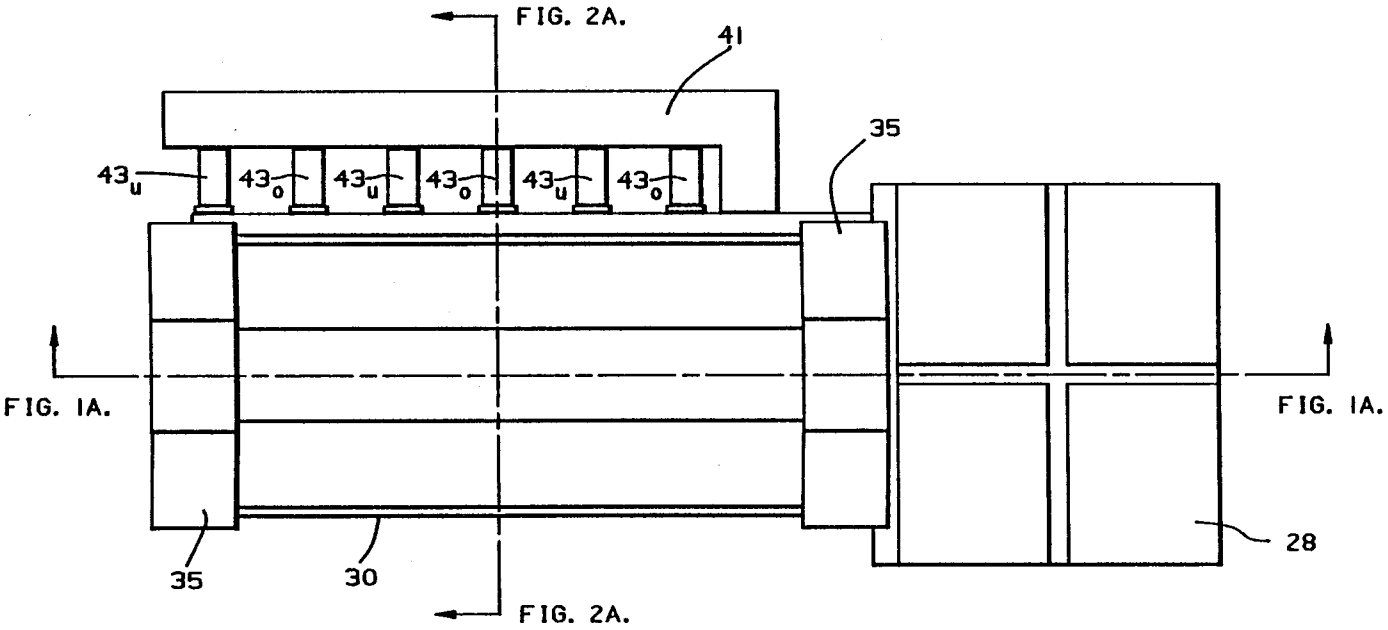
FIG. 1B is a schematic top plan view of the rotary combustor illustrated in FIG. 1A.

As described in U.S. Pat. No. 3,822,651 to Harris et al, incorporated herein by reference, and with concurrent reference to FIGS. 1A, 2A and 2B hereof, a water-cooled combustion barrel 10 is generally cylindrical in shape, having a generally cylindrical side wall 30 formed of longitudinally extending cooling pipes 24 and gas-porous interconnections 31, such as perforated webs (FIG. 1A illustrating only a few such webs 31 between adjacent cooling pipes 24). The combustion barrel 10 has a central axis of rotation which is inclined slightly from the horizontal, proceeding downwardly from the input end 16 to the exit end 18. Thus, the cooling pipes 24 and perforated webs 31 are also slightly inclined from the input end 16, until the pipes 24 bend inside the flue 28. The cooling pipes 24 have first and second ends disposed adjacent the exit end 18 and input end 16, respectively, of the barrel 10.

The perforated webs 31 are preferably formed of bar steel having openings 32 therein, for supplying combustion air to the interior of the combustion barrel 10. The webs 31 extend from the input end 16 and along the generally straight axial portions of the pipes 24 to an angled section **24*a* inside the flue 28. No webs 31 are included after the angled section 24*a* in which the cooling pipes 24 extend in a somewhat converging relationship to the exit end 18 of the barrel 10; thus permitting the exhaust gas 20 and ash 22 to escape more easily from the barrel 10**.

Figure 2A:
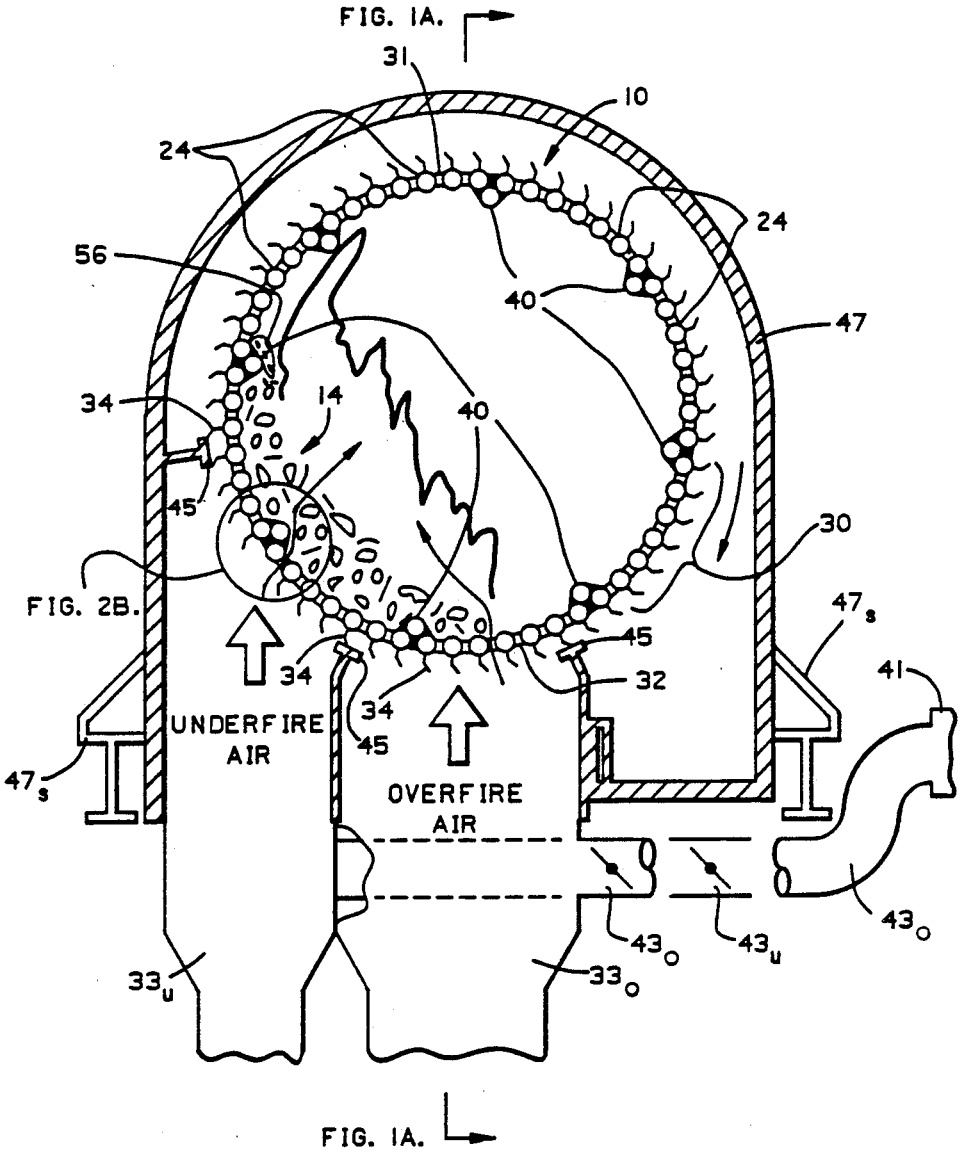
FIG. 2A is a cross-sectional, end elevational schematic view of the rotary combustor illustrated in FIG. 1A.

Referring to FIGS. 1A and 2A, the combustion air is supplied by windboxes 33 disposed under the combustion barrel 10. The windboxes 33 receive the combustion air under pressure from a blower (not shown) via an air duct 41 and control ducts 43. The pressure is maintained by seal strips 34 which extend longitudinally along the exterior of the combustion barrel 10 and have a dogleg-shaped cross-section, as illustrated in FIG. 2A. Each of the seal strips 34 are continuous for at least the axial length of one windbox 33 and help form a pressure seal against windbox edges 45 so that the combustion air exiting the windboxes 33 enters the combustion barrel 10.

The exhaust gases 20 generated by burning the waste material 14 are contained by an enclosure 47, illustrated in FIG. 2A but excluded from FIG. 1A to simplify the drawing. The enclosure 47 is supported on a suitable surface by supports **47*s*. An induced draft fan (not shown) is coupled to the flue 28 downstream from the rotary combustor to maintain the flue 28 at slightly below atmospheric pressure. Thus, essentially all exhaust gases 20 exit from the combustion barrel 10 via the flue 28**.

As illustrated in FIG. 2A, some of the openings 32 remain uncovered due to the shifting of the waste material 14 to one side during rotation of the barrel 10. These openings 32 enable the overfire windboxes **33*o* to supply "overfire" air from control ducts 43*o* to the upper surface of the waste material 14. Simultaneously, "underfire" air from control ducts 43*u* is supplied by underfire windboxes 33*u* to the portion of the waste material 14 in contact with the side wall 30. Typically, the waste material 14 includes large, irregularly shaped objects which permit the "underfire" air to filter through the material 14, at least near the input end 16 of the combustion barrel 10. Combustion typically is initiated in the barrel 10 by using an auxiliary fuel, such as oil or natural gas, which can be supplied through the input end 16 of the combustion barrel 10**, as disclosed in Harris et al. '651.

The combustion barrel 10 is encircled by bands 35 of generally annular configuration which are suitably connected to the outer periphery of the generally cylindrical array of pipes 24, and which in turn are received on rollers 12. The barrel 10 is slowly rotated, e.g., at one-sixth rpm, by either driving the rollers 12 or by providing a separate ring gear secured to the barrel 10 and driven by a pinion, as disclosed in Harris et al. '651. Coolant is circulated through the cooling pipes 24 during rotation of the barrel 10 by a pump 29 which is connected to the supply pipes 26 by a conventional rotary joint 36, such as the joint disclosed in Harris et al. '651. A double-walled, or coaxial, pipe 37, extending along the axis of rotation of the barrel 10, is preferably used to join the supply pipes 26 to the joint 36. The high-energy coolant discharged from the barrel 10 is circulated by the pump 29 through heat-exchanging equipment 27 and low-energy coolant is returned by the pump 29 to the barrel 10.

In the first embodiment, illustrated in FIG. 1A, the supply pipes 26 connect the coaxial pipe 37 to a ring header 38 to supply the low-energy coolant to first ends of the pipes 24 at the exit end 18 of the barrel 10 and to discharge the high-energy coolant to the coaxial pipe 37. The ring header 38 distributes the low-energy coolant to the first pipe ends of, e.g., every other cooling pipe 24. The coolant flows to second ends of the pipes 24 and is returned to the ring header 38 via U-tubes 39 via respective, alternate ones of the cooling pipes 24. In accordance with the present invention, baffle pipes 40, described in detail below, also have first pipe ends coupled to the ring header 38 and U-tubes 39. Therefore, for example, coolant may flow from the first end of a baffle pipe 40 to the second end of that baffle pipe 40, through a U-tube 39 into the second end of a cooling pipe 24 to return to the ring header 38. This arrangement provides maximum cooling of the baffle pipes 40 which are exposed to heat over a larger portion of their surface than the cooling pipes 24.

According to a second embodiment of the present invention, the cooling pipes 24 may be grouped so that each group forms an arc of 60° or 90°, depending on the size of the barrel. In the case of groups each forming a 90° arc, two groups or quadrants of cooling pipes 24 form a first set of pipes which receives coolant from the ring header 38 at the exit end 18 and the other two quadrants form a second set of pipes which return the coolant to the ring header 38. Thus, as illustrated in FIG. 1A, two of the supply pipes 26, e.g., pipes 42 and 44, can be used to supply low-energy coolant to two diametrically opposite quadrants of cooling pipes 24, while supply pipes 46 and 48 receive the high-energy coolant returned through and exiting from the remaining two quadrants of cooling pipes 24.

Figure 4:
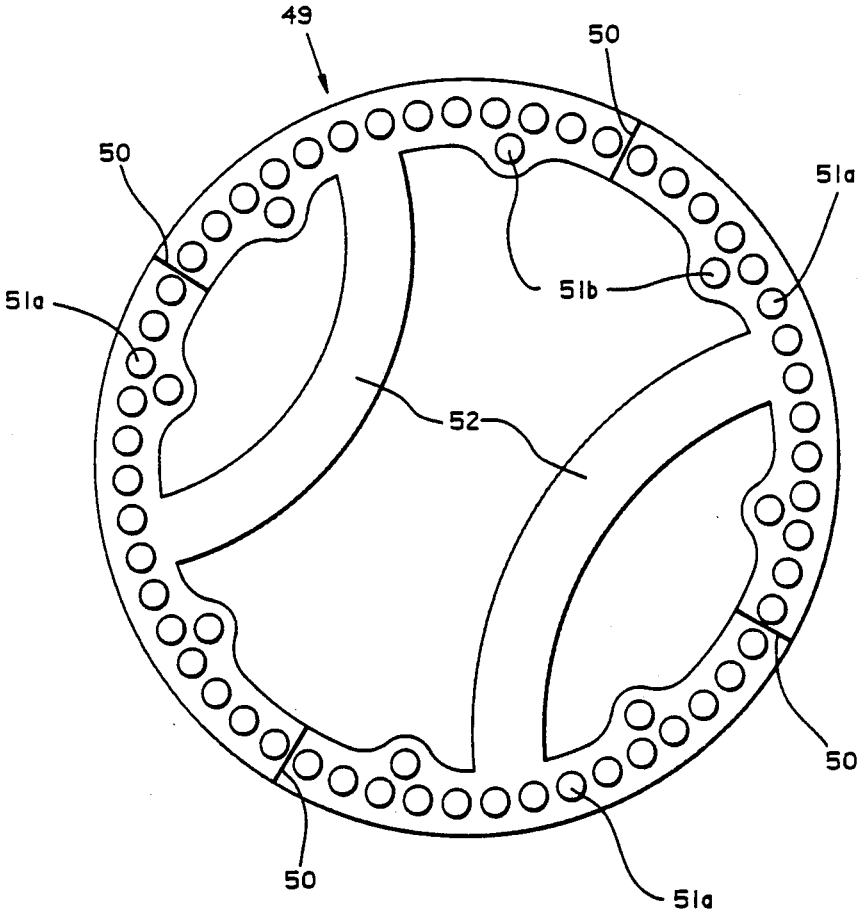
FIG. 4 is a cross-sectional, end elevational schematic view of a return header at the input end of the combustion barrel in a second embodiment of the present invention.

In the second embodiment, the U-tubes 39 are replaced by a return header 49, illustrated in cross section in FIG. 4. As illustrated in FIG. 4, the return header 49 has a generally annular shape which is hollow except for partitions 50. A series of holes 51*a* are located along a circle on one face of the return header 49 to couple to the second ends of the cooling pipes 24. Another sets of holes 51*b* are located along a concentric circle with a smaller radius on the same face of the return header 49 to couple to the second ends of baffle pipes 40. The return header 49 includes cross passages 52 for transferring coolant from one quadrant, defined by partitions 50, to an adjacent quadrant. Other alternatives, such as supplying coolant to adjacent quadrants and returning it along quadrants diametrically opposite the first set of quadrants, or grouping the pipes in other ways, are also possible.

As noted above, both the baffle pipes 40 and the cooling pipes 24 are connected to the ring header 38 at their respective first ends. To accommodate these connections, the ring header 38 may include two rings of holes 53*a* and 53*b* (FIG. 3) on the face disposed toward the pipes 24 and 40. Four holes (not shown) are provided on the opposite face of the header 48 to accommodate the supply and exit pipes 42, 44 and 46, 48. Since the baffle pipes 40 extend longitudinally along a cylinder having a smaller diameter than the cooling pipes 24, the ring header 38 includes periodic openings 53*b* along a circle corresponding to the first ends of the baffle pipes 40. This circle is concentric with the circle forming the locus of the openings 53*a* for the cooling pipes 24 and has a smaller radius. Thus, the first ends of the cooling pipes 24 are coupled to respective openings 53*a*, and the first ends of the baffle pipes 40 are coupled to respective openings 53*b* in the ring header 38. Alternatively, only the larger circle of openings 53*a* can be provided with each of the baffle pipes 40 being coupled to the ring header 38 via shunts from a cooling pipe 24 adjacent thereto. In either case, as best illustrated in FIGS. 2 and 4, the cooling pipes 24 are separated by a first spacing distance, while the baffle pipes 40 are separated by a second spacing distance, much more than twice as large as the first spacing distance.

Figure 2B:
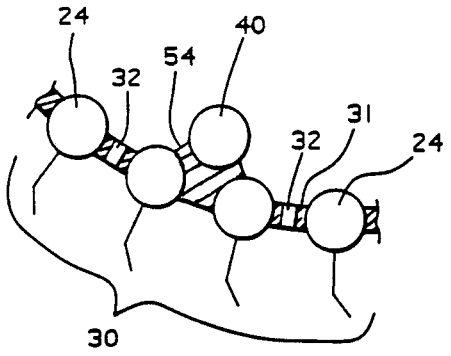
FIG. 2B is an enlargement of a portion of FIG. 2A.
Figure 3:
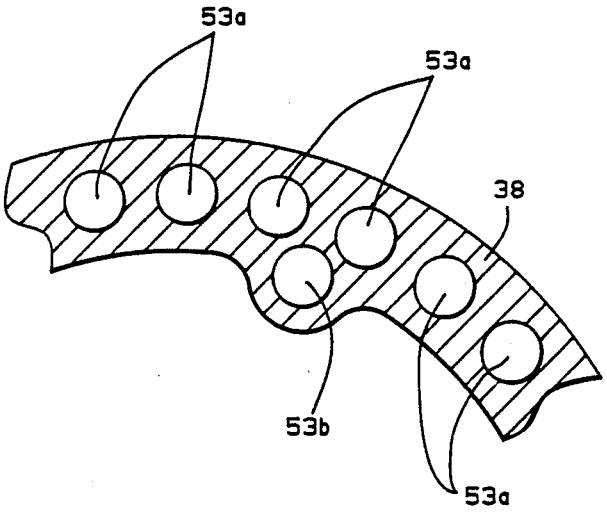
FIG. 3 is cross-sectional end view of a portion of a ring header at the exit end of the combustion barrel.

The baffle pipes 40 are preferably formed of non-porous material which is impervious to both gas and liquid, such as carbon steel. As illustrated in FIG. 2B, the baffle pipes 40 are preferably welded or otherwise attached, as indicated by weld beads 54, to two of the cooling pipes 24. This method of attachment provides excellent structural rigidity to the baffle pipes 40, affording the ability to lift heavy items of solid waste material 14. As illustrated in FIG. 2A, transported material 56 is raised from the bottom of the heaped material 14 to be exposed to higher temperatures and greater quantities of combustion air.

In addition to transferring the lowest portion of the heaped waste material 14 to the upper portion of the heap, the baffles 40 also tend to create a small eddy as other portions of the waste material 14 fall into the area vacated by the transported material 56. This allows a greater quantity of air to be supplied in the "underfire" region and more efficient combustion of the portions of the waste material 14 which are not transported by the baffles 56. This agitation of the waste material 14 results in substantially complete combustion of a greater portion of the waste material 14 than occurred in those prior art combustors which have relatively smooth interior side walls 30.

The extent, or degree, of agitation is a function of the diameter of the baffle pipes 40. By increasing the diameter, the amount of agitation is increased. Large diameter baffle pipes are preferable to the uncooled fins used in the prior art, as disclosed in O'Connor '024. Such fins must be formed of metals which are capable of withstanding higher temperatures than the temperatures to which the carbon steel cooling pipes 24 and baffles pipes 40 are exposed, or else the temperature in the combustion barrel 10 must be maintained below that at which carbon steel becomes subjected to deleterious effects such as increased fatigue. Thus, more expensive steel alloys may be required for such fins.

The many features and advantages of the present invention are apparent from the detailed specification, and thus, it is intended by the appended claims to cover all such features and advantages of the device which fall within the true spirit and scope of the invention. Further, since numerous modifications and changes will readily occur to those skilled in the art, it is not desired to limit the invention to the exact construction and operation illustrated and described. Accordingly, all suitable modifications and equivalents may be resorted to falling within the scope and spirit of the invention.

What is claimed is:

1. A combustion barrel in a rotary combustor used for burning solid material, the rotary combustor being connected to heat exchanging equipment, said combustion barrel comprising:

a generally cylindrical side wall rotatable about a central axis of rotation and having an input end and an exit end, said side wall comprising plural cooling pipes, extending longitudinally in parallel axial relationship, separated by a first spacing distance, and having first and second pipe ends at the exit and input ends, respectively, and plural gas-porous interconnections extending longitudinally, each of said gas-porous interconnections being disposed intermediate an adjacent pair of said cooling pipes and rigidly interconnecting same;

baffle pipes, attached to the interior of said generally cylindrical side wall, extending longitudinally with adjacent baffle pipes separated by a second spacing distance more than twice as large as the first spacing distance, and having first and second pipe ends at the exit and input ends, respectively, of said side wall, for agitating the solid material as said combustion barrel is rotated;

a ring header, having a generally annular shape, coupled to said heat exchanging equipment, for supplying coolant to, and discharging coolant from, said cooling pipes and said baffle pipes;

coupling means for coupling and sealing said first pipe ends of said cooling and baffle pipes to said ring header, supplying coolant to a first set of pipes selected from among said cooling pipes and said baffle pipes and discharging coolant from a second set of pipes corresponding to the remaining ones of said cooling pipes and said baffle pipes; and return means for returning the coolant from said second ends of said cooling and baffle pipes in the first set of pipes to said ring header via the second set of pipes.

2. A combustion barrel as recited in claim 1, wherein said baffle pipes have non-porous walls impervious to gas and liquid.

3. A combustion barrel as recited in claim 1, wherein each of said baffle pipes is attached to two of said cooling pipes forming said generally cylindrical side wall.

4. A combustion barrel as recited in claim 1, wherein said return means comprises U-tubes, each coupled and sealed to the second ends of two pipes, one of the two pipes being selected from the first set of pipes and the other being selected from the second set of pipes.

5. A combustion barrel in a rotary combustor used for burning solid material, the rotary combustor being connected to heat exchanging equipment, said combustion barrel comprising:

a generally cylindrical side wall rotatable about a central axis of rotation and having an input end and an exit end, said side wall comprising plural cooling pipes, extending longitudinally in parallel axial relationship, separated by a first spacing distance, grouped in quadrants and having first and second pipe ends at the exit and input ends, respectively, and plural gas-porous interconnections extending longitudinally, each of said gas-porous interconnections being disposed intermediate of an adjacent pair of said cooling pipes and rigidly interconnecting same;

baffle pipes, attached to the interior of and grouped in the quadrants around said generally cylindrical side wall, extending longitudinally with adjacent baffle pipes separated by a second spacing distance more than twice as large as the first spacing distance, and having first and second pipe ends at the exit and input ends, respectively, of said side wall, for agitating the solid material as said combustion barrel is rotated;

a ring header, having a generally annular shape, coupled to said heat exchanging equipment and separated into quadrants corresponding to the quadrants in which said cooling pipes and said baffle pipes are grouped, for supplying coolant to said cooling pipes and said baffle pipes in two diametrically opposes quadrants and discharging water from said cooling and baffle pipes in the remaining two quadrants;

coupling means for coupling and sealing said first pipe ends of said cooling and baffle pipes to said ring header, supplying coolant to a first set of pipes selected from among said cooling pipes and said baffle pipes and discharging coolant from a second set of pipes corresponding to the remaining ones of said cooling pipes and said baffle pipes; and return means for returning the coolant from said second ens of said cooling and baffle pipes in the first set of pipes to said ring header via the second set of pipes, said return means comprising a return header, coupled and sealed to the second pipe ends of said cooling and baffle pipes, for transferring the coolant from the two diametrically opposed quadrants to the two remaining quadrants.

6. A combustion barrel in a rotary combustor used for burning solid material, the rotary combustor being connected to heat exchanging equipment, said combustion barrel comprising:

a generally cylindrical side wall rotatable about a central axis of rotation and having first and second ends, said side wall comprising plural cooling pipes, extending longitudinally in parallel axial relationship, separated by a first spacing distance, and having first and second pipe ends at the exit and input ends, respectively, and plural gas-porous interconnections extending longitudinally, each of said gas-porous interconnections being disposed intermediate an adjacent pair of said cooling pipes and rigidly interconnecting same;

baffle pipes, extending longitudinally with adjacent baffle pipes separated by a second spacing distance more than twice as large as the first spacing distance, having non-porous walls impervious to gas and liquid and having first and second pipe ends at the exit and input ends, respectively, of said side wall, each of said baffle pipes attached inside the generally cylindrical side wall to two of said cooling pipes, said baffle pipes agitating the solid material as said combustion barrel is rotated;

a ring header, having a generally annular shape, coupled to said heat exchanging equipment and said first pipe ends of said cooling and baffle pipes, for supplying low-energy coolant to said cooling pipes and said baffle pipes from said heat exchanging equipment and for supplying high-energy coolant from said cooling pipes and said baffle pipes to the heat exchanging equipment;

coupling means for coupling and sealing said first pipe ends of said cooling and baffle pipes to said ring header, supplying coolant to a first set of pipes selected from among said cooling pipes and said baffle pipes and discharging coolant from a second set of pipes corresponding to the remaining ones of said cooling pipes and said baffle pipes; and return means, for returning the coolant from said second end of said cooling and baffle pipes in the first set of pipes to said ring header via the second set of pipes.

7. A combustion barrel as recited in claim 6, wherein said return means comprises U-tubes, each coupled and sealed to the second end of two pipes, one of the two pipes being selected from the first set of pipes and the other being selected from the second set of pipes.

8. A combustion barrel as recited in claim 6, wherein:

said cooling pipes and said baffle pipes are grouped in quadrants around the generally cylindrical side wall, said ring header is separated into quadrants corresponding to the quadrants in which said cooling pipes and said baffle pipes are grouped, said ring header supplying coolant to said cooling pipes and said baffle pipes in two diametrically opposed quadrants and discharging water from said cooling and baffle pipes in the remaining two quadrants, and said return means comprises a return header, coupled and sealed to the second pipe ends of said cooling and baffle pipes, for transferring the coolant from the two diametrically opposed quadrants to the two remaining quadrants.

* * * * *